US011693333B2

(12) United States Patent
Kim et al.

(10) Patent No.: US 11,693,333 B2
(45) Date of Patent: Jul. 4, 2023

(54) TONER CARTRIDGE HAVING COUPLER COVER MOVABLE INTERCONNECTED WITH SHUTTER

(71) Applicant: HEWLETT-PACKARD DEVELOPMENT COMPANY, L.P., Spring, TX (US)

(72) Inventors: Jinhong Kim, Suwon (KR); Minwoo Kang, Suwon (KR); Jinsam Park, Suwon (KR); Seungchan Park, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/754,332

(22) PCT Filed: Jun. 10, 2020

(86) PCT No.: PCT/US2020/036941
§ 371 (c)(1),
(2) Date: Mar. 30, 2022

(87) PCT Pub. No.: WO2021/137889
PCT Pub. Date: Jul. 8, 2021

(65) Prior Publication Data

US 2022/0342348 A1 Oct. 27, 2022

(30) Foreign Application Priority Data

Jan. 2, 2020 (KR) ..... 10-2020-0000230

(51) Int. Cl.
*G03G 15/08* (2006.01)
*G03G 21/16* (2006.01)

(52) U.S. Cl.
CPC ..... *G03G 15/0886* (2013.01); *G03G 21/1676* (2013.01)

(58) Field of Classification Search
CPC ..... G03G 15/0865; G03G 15/0886; G03G 21/1676; G03G 2215/067
See application file for complete search history.

(56) References Cited

U.S. PATENT DOCUMENTS

| | | | |
|---|---|---|---|
| 9,625,875 | B2 | 4/2017 | Handa et al. |
| 10,042,287 | B2 | 8/2018 | Mimura et al. |
| 2015/0016850 | A1 | 1/2015 | Handa et al. |

(Continued)

FOREIGN PATENT DOCUMENTS

| | | | |
|---|---|---|---|
| CN | 102253622 | A | 11/2011 |
| CN | 102253621 | B | 4/2015 |

(Continued)

*Primary Examiner* — Sophia S Chen
(74) *Attorney, Agent, or Firm* — Foley & Lardner LLP

(57) ABSTRACT

An example toner cartridge includes a housing to contain toner and having a toner outlet, a conveying member, a shutter to open and close the toner outlet, a driven coupler to rotate the conveying member and having an extension that extends in an axial direction, and a protruding member including a rotational force receiver installed in the extension so as to move to a protruding position in which the rotational force receiver protrudes from the extension and a retracted position in which the rotational force receiver is received into the extension in conjunction with opening and closing operations of the shutter.

13 Claims, 11 Drawing Sheets

(56) References Cited

U.S. PATENT DOCUMENTS

| | | | | |
|---|---|---|---|---|
| 2015/0153682 | A1 | 6/2015 | Okubo et al. | |
| 2018/0181026 | A1* | 6/2018 | Mimura ..... | G03G 15/0886 |
| 2018/0203382 | A1 | 7/2018 | Mimura | |

FOREIGN PATENT DOCUMENTS

| | | | |
|---|---|---|---|
| JP | 2009122213 | A | 6/2009 |
| JP | 2018105914 | | 7/2018 |

* cited by examiner

TONER CARTRIDGE HAVING COUPLER COVER MOVABLE INTERCONNECTED WITH SHUTTER

BACKGROUND

An image forming apparatus using an electrophotographic method supplies toner to an electrostatic latent image formed on a photoreceptor to form a visible toner image on the photoreceptor, transfers the toner image to a print medium directly or via an intermediate transfer medium, and fixes the transferred toner image on the print medium.

The image forming apparatus may include a toner cartridge which is detachably mounted in a main body. The toner cartridge may be replaced when toner contained therein is consumed. When toner contained in the toner cartridge is consumed, the toner cartridge may be removed from the main body, and a new toner cartridge may be attached to the main body.

BRIEF DESCRIPTION OF DRAWINGS

Various examples will be described below by referring to the following figures.

DETAILED DESCRIPTION OF EXAMPLES

An "image forming apparatus" may refer to any type of apparatus capable of performing an image forming job, such as a printer, a copier, a scanner, a fax machine, a multifunction printer (MFP), a display apparatus, etc. In the following example, the image forming apparatus is described as a monochrome image forming apparatus employing a two-component developer containing a toner and a magnetic carrier, wherein the color of the toner is black. However, the following description applies generally to other types of image forming apparatuses.

Figure 1:
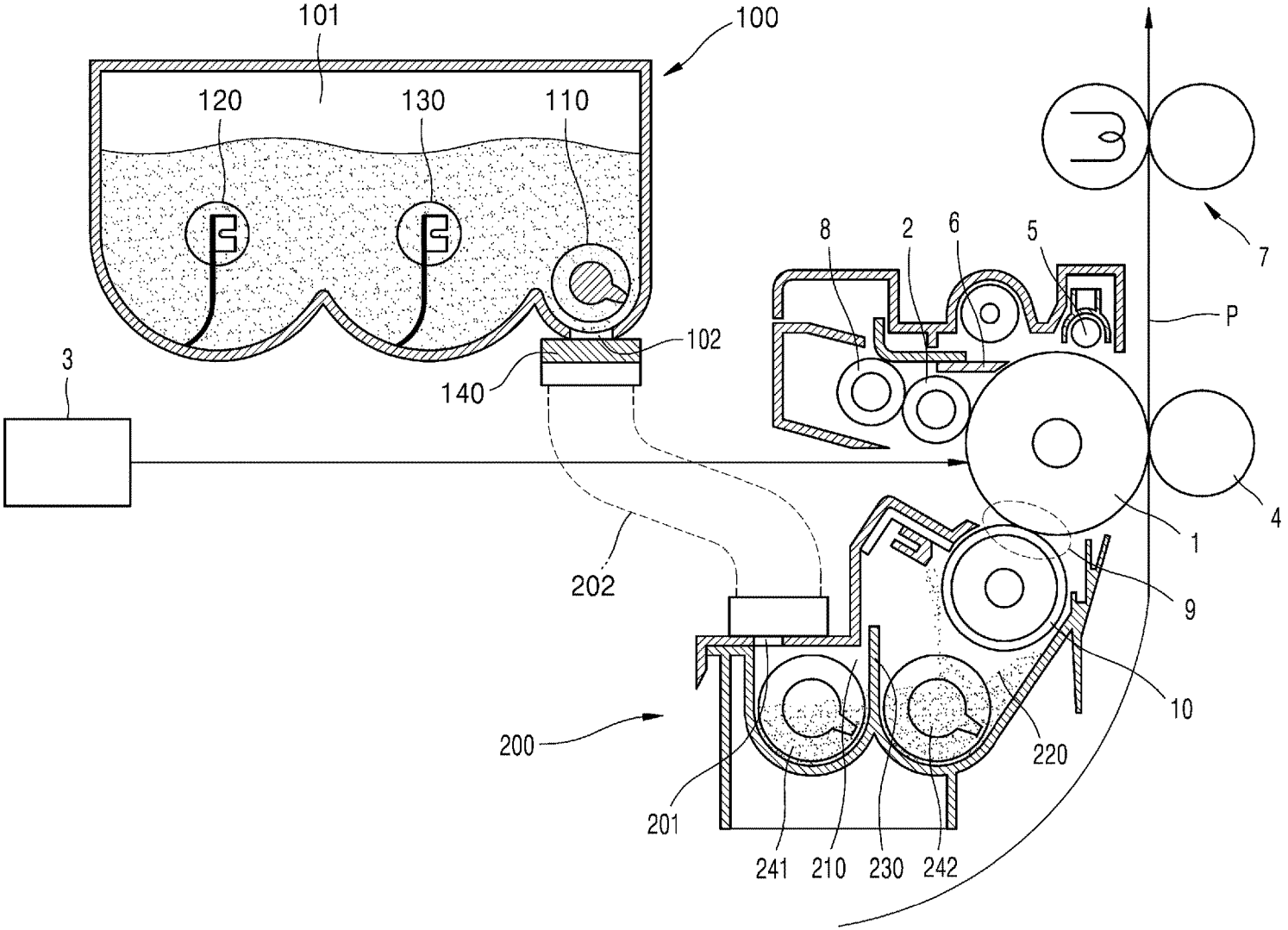
FIG. 1 is a diagram of an electrophotographic image forming apparatus according to an example.

FIG. 1 is a diagram of an electrophotographic image forming apparatus according to an example.

Referring to FIG. 1, the image forming apparatus may include an optical scanner 3, a developing unit 200, a transfer unit, and a fixing unit 7. The developing unit 200 may include a photosensitive drum 1 and a developing roller 10. The developing unit 200 mixes and stirs the toner and the magnetic carrier. The developing roller 10 supplies toner to an electrostatic latent image formed on the photosensitive drum 1 to form a visible toner image on a surface of the photosensitive drum 1. The optical scanner 3 irradiates the surface of the electrically charged photosensitive drum 1 with light corresponding to image information to form an electrostatic latent image.

As the optical scanner 3, for example, a laser scanning unit (LSU) may be employed in which light irradiated from a laser diode is deflected in a main scanning direction by using a polygon mirror to scan the photosensitive drum 1. As the optical scanner 3, a bar optical scanner in which a plurality of light emitting devices, for example, light emitting diodes (LEDs) that are on/off driven corresponding to image information are arranged in a main scanning direction, may be employed.

The photosensitive drum 1 is an example of a photoconductor on which an electrostatic latent image may be formed. The photosensitive drum 1 may include a cylindrical metal pipe and a photosensitive layer having photoconductivity formed on the outer circumference of the metal pipe. A charging roller 2 is an example of a charger for electrically charging the surface of the photosensitive drum 1 to a uniform electric surface potential. The charging roller 2 is rotated in contact with the photosensitive drum 1, and a charging bias voltage is applied to the charging roller 2. As the charger, a corona charger that charges the surface of the photosensitive drum 1 by applying a bias voltage between a plate electrode and a wire electrode to generate corona discharge may be employed. A cleaning roller 8 removes foreign matter on a surface of the charging roller 2. A cleaning blade 6 removes toner remaining on the surface of the photosensitive drum 1 after a transfer process. On an upstream side of the cleaning blade 6 based on a rotational direction of the photosensitive drum 1, a charge eliminator 5 for removing a residual electric potential on the photosensitive drum 1 may be arranged. For example, the charge eliminator 5 may irradiate light on the surface of the photosensitive drum 1.

The developing unit 200 may include a stirring chamber 210 and a developing chamber 220 parallel to each other. A first stirrer 241 is installed in the stirring chamber 210. In the developing chamber 220, the developing roller 10 and a second stirrer 242 are installed. The stirring chamber 210 and the developing chamber 220 are partitioned from each other by a partition wall 230 extending in an axial direction of the developing roller 10. An opening (not shown) is provided in each of both ends in a longitudinal direction of the partition wall 230, that is, in the axial direction of the developing roller 10. The stirring chamber 210 and the developing chamber 220 are connected to each other by the openings. The first and second stirrers 241 and 242 may be, for example, an auger having a shaft extending in the axial direction of the developing roller 10 and a spiral blade formed along an outer periphery of the shaft. When the first stirrer 241 is rotated, a developer in the stirring chamber 210 is conveyed in the axial direction (first direction) by the first stirrer 241, and is conveyed to the developing chamber 220 through an opening provided near one end of the partition wall 230. In the developing chamber 220, the developer is conveyed by the second stirrer 242 in a second direction opposite to the first direction. Also, the developer is conveyed to the stirring chamber 210 through an opening provided near the other end of the partition wall 230. As a result, the developer is circulated along the stirring chamber 210 and the developing chamber 220, and is supplied to the developing roller 10 located in the developing chamber 220 in the circulation process.

The developing roller 10 conveys the developer including a toner and a carrier to a developing area 9 facing the photosensitive drum 1. The toner is attached to the carrier by an electrostatic force, and the carrier is attached to the surface of the developing roller 10 by a magnetic force. As a result, a developer layer is formed on the surface of the developing roller 10. The developing roller 10 may be located to be apart from the photosensitive drum 1 by a developing gap. The developing gap may be set to about tens to about hundreds of micrometers. The toner is moved from the developing roller 10 to the photosensitive drum 1 by a developing bias voltage applied between the developing roller 10 and the photosensitive drum 1, and a visible toner image is formed on the surface of the photosensitive drum 1.

A transfer roller 4 is an example of a transfer unit for transferring the toner image formed on the photosensitive drum 1 to a print medium P. The transfer roller 4 faces the photosensitive drum 1 to form a transfer nip, and a transfer bias voltage is applied to the transfer roller 4. The toner image developed on the surface of the photosensitive drum 1 is transferred to the print medium P by a transfer electric field formed between the photosensitive drum 1 and the transfer roller 4 by the transfer bias voltage. Instead of the transfer roller 4, a corona transfer unit using corona discharge may be employed.

The toner image transferred to the print medium P is attached to the print medium P by an electrostatic force. The fixing unit 7 applies heat and pressure to fix the toner image to the print medium P.

When the toner in the developing unit 200 is consumed, toner may be supplied from a toner container 100 to the developing unit 200. The toner container 100 includes a housing 101 in which toner is accommodated. A toner outlet 102 is provided in the housing 101. A conveying member conveys the toner inside the housing 101 to the toner outlet 102. The toner outlet 102 and a toner supply port 201 of the developing unit 200 may be connected to each other by a toner supply member 202.

For example, the conveying member may include a toner discharge member 110 in the form of a rotating auger for conveying toner in the axial direction, and paddle members 120 and 130 for conveying the toner in the housing 101 toward the toner discharge member 110. When the paddle members 120 and 130 are rotated, the toner inside the housing 101 is conveyed toward the toner discharge member 110. The toner discharge member 110 conveys the toner to the toner outlet 102. The toner container 100 may include a shutter 140 that selectively opens and closes the toner outlet 102.

The toner container 100 may be implemented in the form of a cartridge which is removably mounted on the image forming apparatus. Hereinafter, the toner container 100 will be referred to as a toner cartridge 100.

Figure 2:
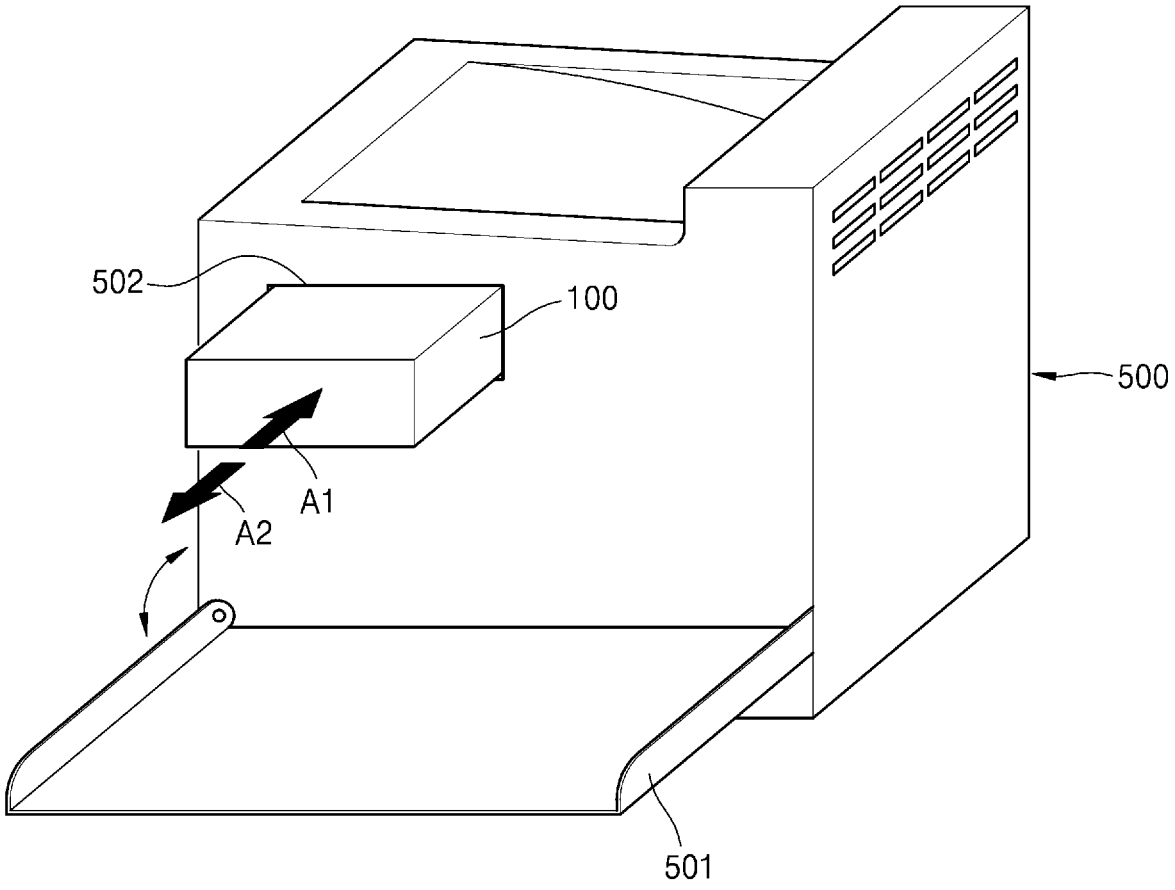
FIG. 2 is a perspective view illustrating replacing a toner cartridge according to an example.
Figure 3:
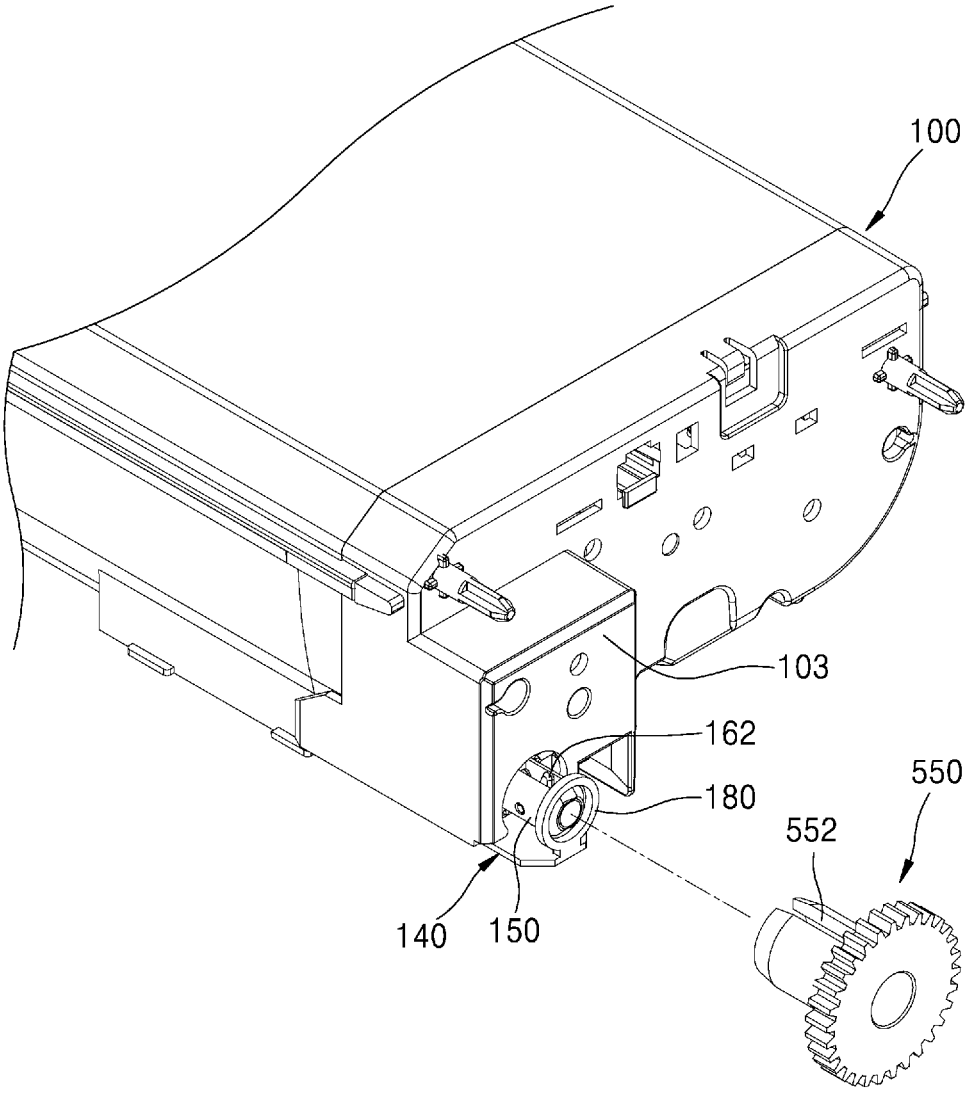
FIG. 3 is a partial perspective view of a toner cartridge according to an example.

FIG. 2 is a perspective view illustrating replacing of a toner cartridge according to an example. FIG. 3 is a partial perspective view of a toner cartridge according to an example.

Referring to FIG. 2, a door 501 may be opened to expose a portion of a main body 500 of the image forming apparatus, and the toner cartridge 100 may be removably mounted on the main body 500. The main body 500 is provided with a mounting portion 502 on which the toner cartridge 100 is mounted. The toner cartridge 100 may be mounted/removed on/from the main body 500 by sliding in a mounting direction A1 and a removal direction A2. The mounting direction A1 and the removal direction A2 may be an axial direction of a rotating member provided in the toner cartridge 100, for example, the toner discharge member 110 and the paddle members 120 and 130.

Referring again to FIG. 1, the shutter 140 is supported by the housing 101 so as to be moved between a closed position that blocks the toner outlet 102 and an open position that opens the toner outlet 102. With the toner cartridge 100 removed from the main body 500, the shutter 140 is located in the closed position. When the toner cartridge 100 is mounted on the main body 500, the shutter 140 is moved to the open position that opens the toner outlet 102.

When the toner cartridge 100 is mounted on the main body 500, the toner cartridge 100 is connected to a motor by a coupling structure, and receives a rotational force from the motor to rotate the rotating member of the toner cartridge 100. The coupling structure may vary. As the coupling structure, a gear-gear coupling structure, a complementary uneven coupling structure, or the like may be used. Referring to FIG. 3, the coupling structure may include a driving coupler 550 provided in the main body 500 and a driven coupler 150 provided in the toner cartridge 100. The driving coupler 550 may include a rotational force transmitter 552. The driven coupler 150 may include a rotational force receiver 162 that receives a rotational force from the rotational force transmitter 552. In an example, the rotational force receiver 162 may have a protrusion shape, and the rotational force transmitter 552 may have a groove shape into which the rotational force receiver 162 is inserted. When the toner cartridge 100 is mounted on the main body 500, the rotational force receiver 162 is inserted into the rotational force transmitter 552. A rotational force of the driving coupler 550 may be transmitted to the driven coupler 150 via the rotational force transmitter 552 and the rotational force receiver 162.

Before the toner cartridge 100 is mounted on the main body 500 or when the toner cartridge 100 is detached from the main body 500, the driven coupler 150 of the toner cartridge 100 is exposed to the outside of the toner cartridge 100. During the handling of the toner cartridge 100, the rotational force receiver 162 may be damaged by an external impact. Therefore, a method for reducing or preventing damage to the rotational force receiver 162 from external impact is desired.

In an example, the toner cartridge 100 has a structure that reduces or prevents damage to the rotational force receiver 162 by using movement of the shutter 140 between the closed position and the open position. Hereinafter, an example of a structure that may reduce or prevent damage to the rotational force receiver 162 from external impact will be described.

Figure 4:
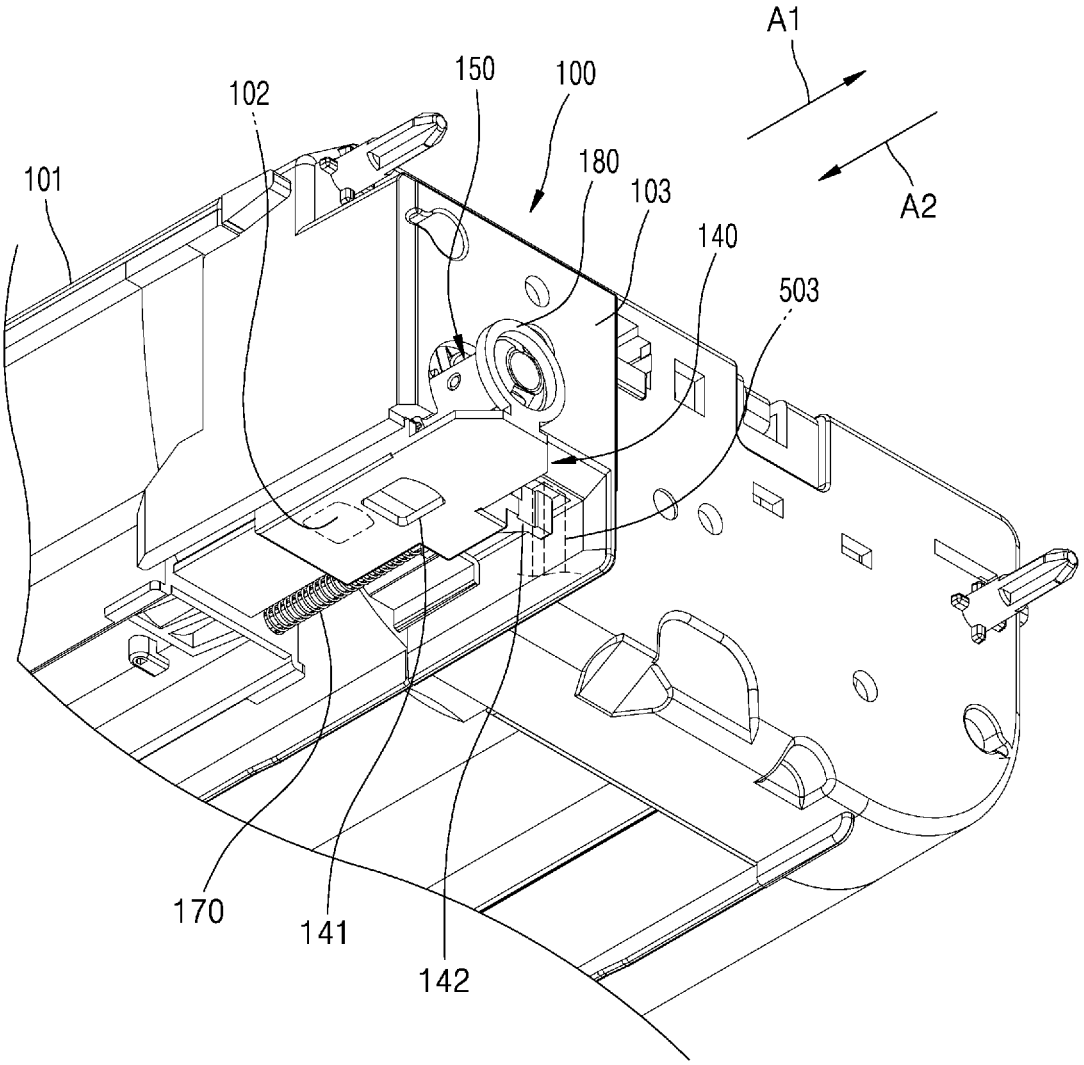
FIG. 4 is a bottom perspective view of a toner cartridge having a structure capable of reducing or preventing damage caused by an external impact to a rotational force receiver and illustrates a state in which a shutter is located in a closed position according to an example.
Figure 5:
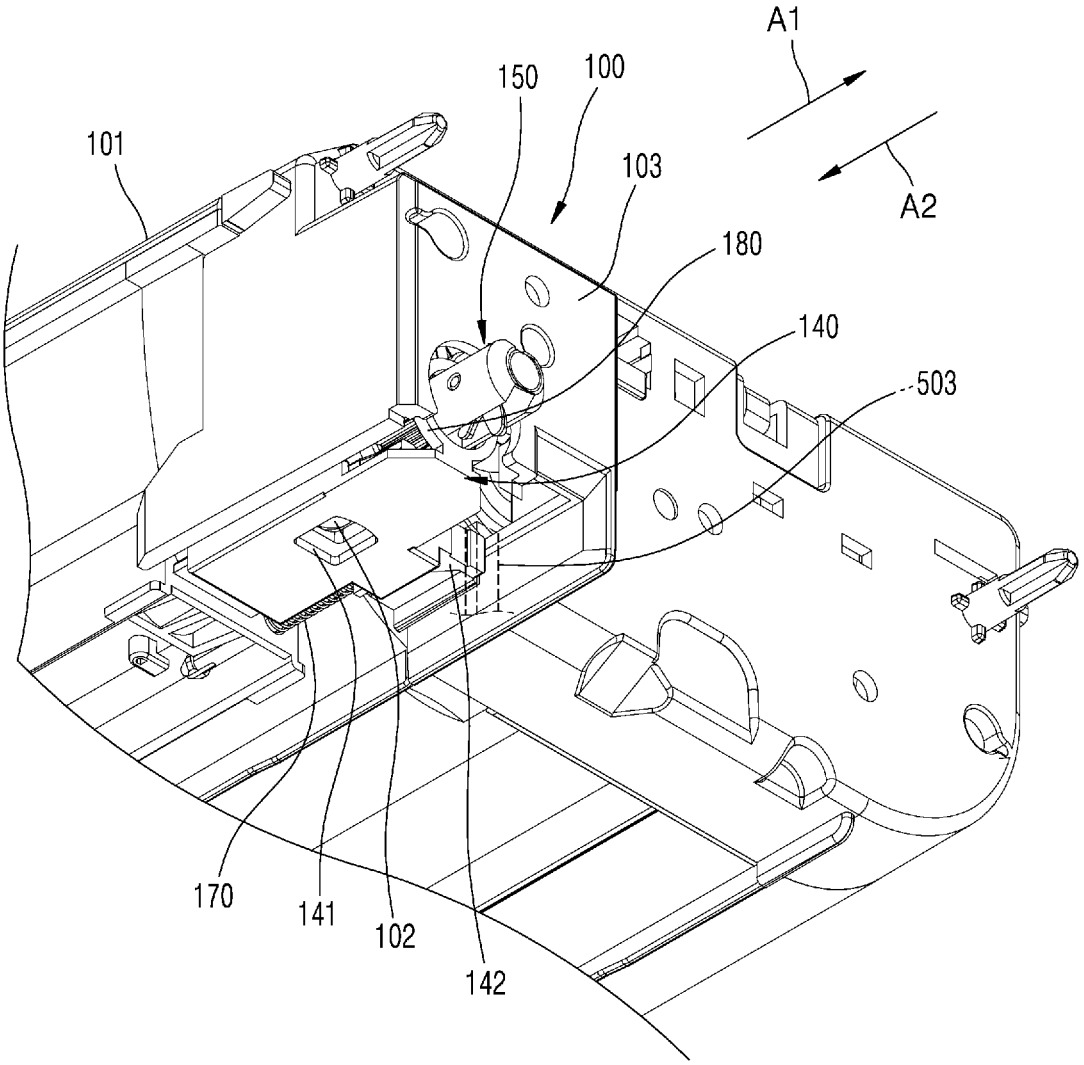
FIG. 5 is a bottom perspective view of a toner cartridge having a structure capable of reducing or preventing damage caused by an external impact to a rotational force receiver and illustrates a state in which a shutter is located in an open position according to an example.
Figure 6:
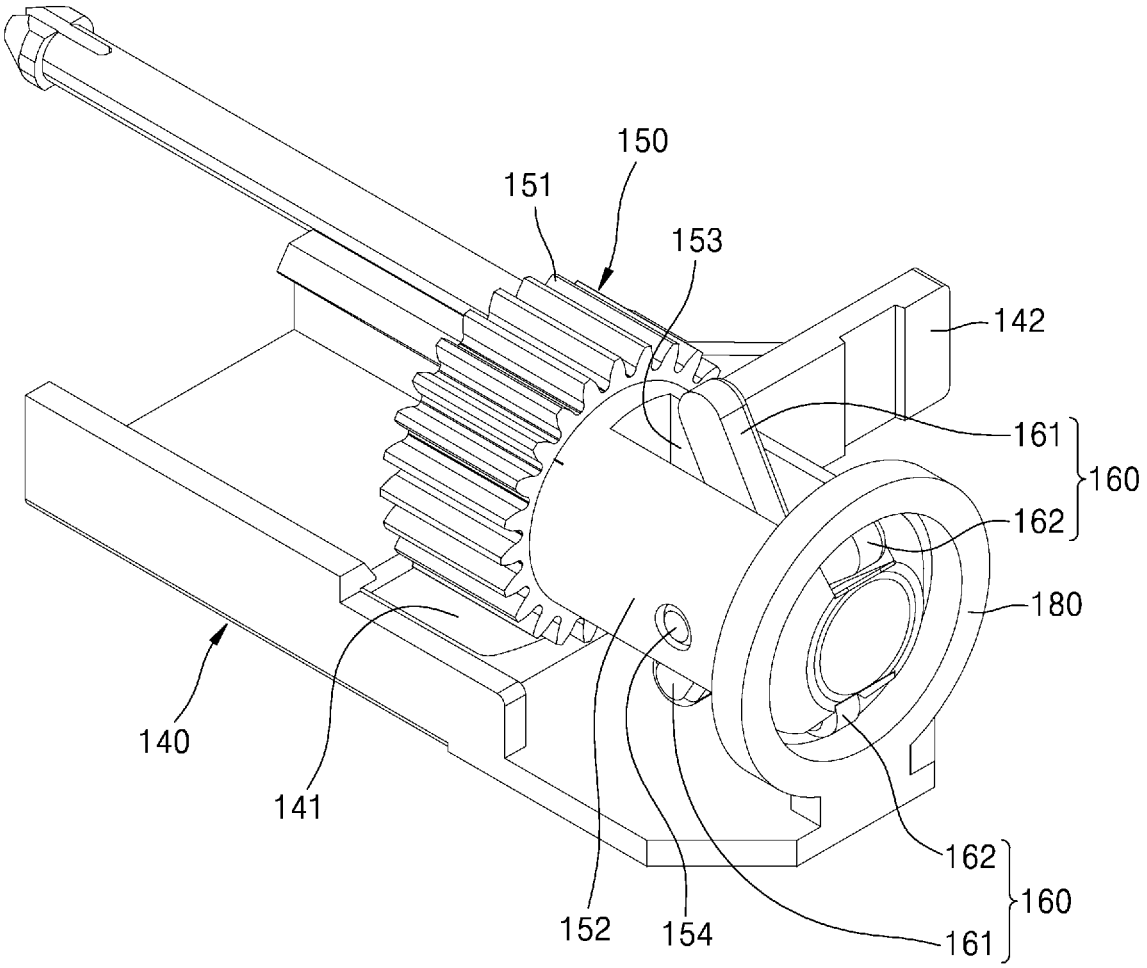
FIG. 6 is a perspective view showing a positional relationship between a shutter and a driven coupler and illustrates a state in which the shutter is located in a closed position according to an example.
Figure 7:
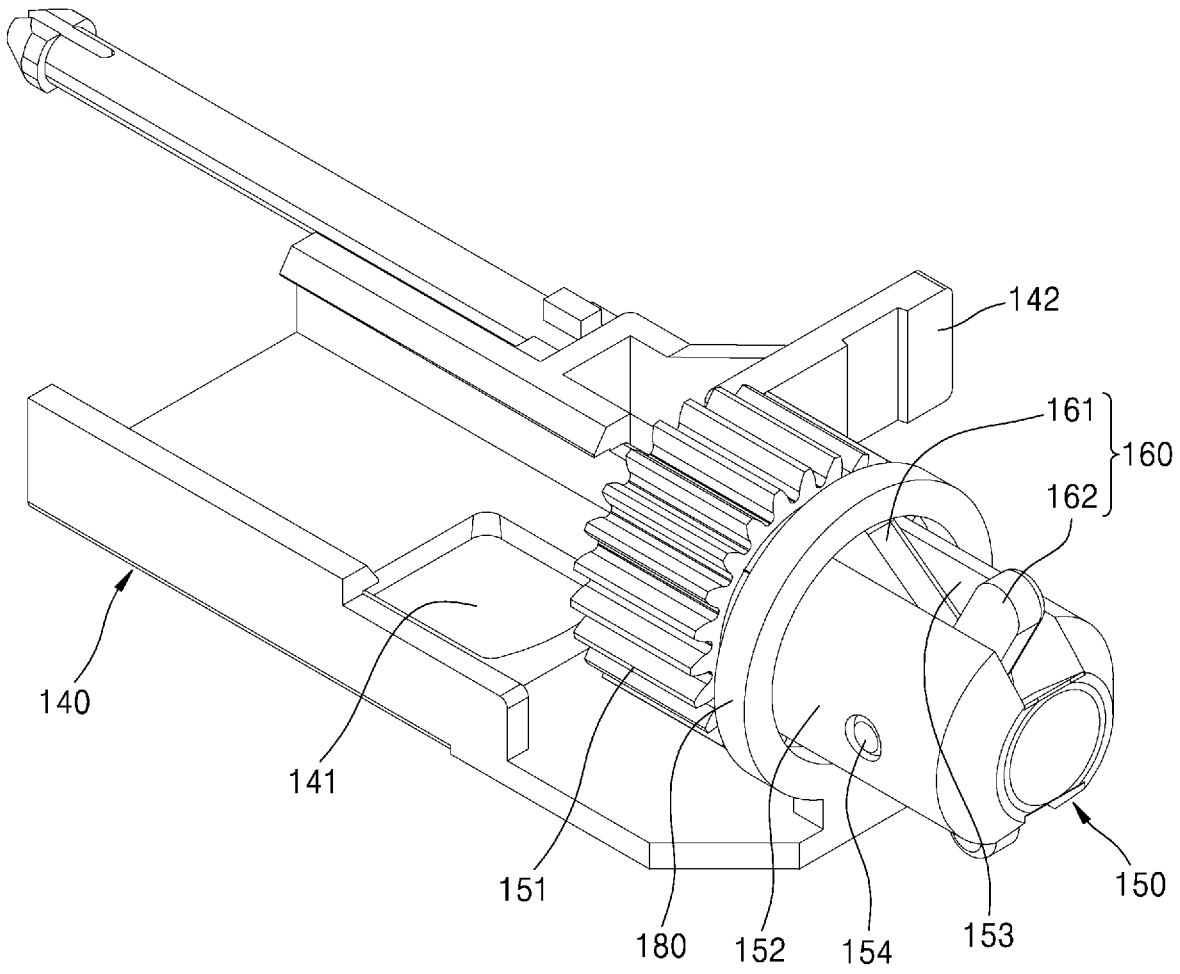
FIG. 7 is a perspective view showing a positional relationship between a shutter and a driven coupler and illustrates a state in which the shutter is located in an open position according to an example.

FIGS. 4 and 5 are bottom perspective views illustrating an example of the toner cartridge 100 having a structure capable of reducing or preventing damage to the rotational force receiver 162 from an external impact, wherein FIG. 4 shows the shutter 140 in a closed position and FIG. 5 shows the shutter 140 in an open position. FIGS. 6 and 7 are perspective views showing a positional relationship between the shutter 140 and the driven coupler 150, wherein FIG. 6 shows the shutter 140 in a closed position and FIG. 7 shows the shutter 140 in an open position.

Referring to FIGS. 1, 2, and 4 to 7, the toner cartridge 100 may include the housing 101 to contain toner and having the toner outlet 102 formed therein, a conveying member to convey toner to the toner outlet 102, the shutter 140 for opening and closing the toner outlet 102, the driven coupler 150 for rotating the conveying member by receiving a rotational force from the outside (e.g., an external source) and having an extension 152 extending in an axial direction, a protruding member 160 provided with the rotational force receiver 162 for receiving the rotational force from the outside and installed in the extension 152 so as to be converted to a protruding position (FIG. 7) in which the rotational force receiver 162 protrudes from the extension 152 to receive the rotational force and a retracted position (FIG. 6) in which the rotational force receiver 162 is received into the extension 152 in conjunction with the opening and closing operations of the shutter 140. The shutter 140 may be moved between a closed position (FIG. 4) for closing the toner outlet 102 and an open position (FIG. 5) for opening the toner outlet 102. The protruding member 160 may be converted from the retracted position to the protruding position when the shutter 140 is moved from the closed position to the open position.

An example of a structure in which the shutter 140 is moved between the closed position and the open position will be described.

In an example, the shutter 140 is supported by the housing 101 to be slidable between the closed position and the open position. The shutter 140 is provided with an opening 141. When the shutter 140 is located in the closed position as shown in FIG. 4, the opening 141 and the toner outlet 102 are misaligned. Thus, the toner outlet 102 is closed. When the shutter 140 is located in the open position as shown in FIG. 5, the opening 141 and the toner outlet 102 are aligned, and the toner outlet 102 is opened. A spring 170 applies an elastic force in a direction in which the shutter 140 is located in the closed position. The spring 170 may be implemented by, for example, a compression coil spring between the housing 101 and the shutter 140. In a state in which the toner cartridge 100 is separated from the main body 500, the shutter 140 is held in the closed position by an elastic force of the spring 170.

By an operation of mounting the toner cartridge 100 to the mounting portion 502, the shutter 140 may be moved between the closed position and the open position. For example, referring to FIGS. 4 and 5, the mounting portion 502 may be provided with an opening lever 503. The shutter 140 may be provided with a latching portion 142 that couples with (e.g., is caught by) the opening lever 503. The opening lever 503 is provided at a position where the latching portion 142 may be caught by the toner cartridge 100 as the toner cartridge 100 approaches a mounting position.

In an example of mounting the toner cartridge 100 to the main body 500, the toner cartridge 100 is inserted into the mounting portion 502 and pushed in the mounting direction A1. When the toner cartridge 100 approaches the mounting position, the latching portion 142 of the shutter 140 is caught by the opening lever 503 as shown in FIG. 4. Even if the toner cartridge 100 is continuously pushed in the mounting direction A1, the shutter 140 may no longer be moved in the mounting direction A1. Accordingly, the shutter 140 is moved relative to the housing 101 in the opposite direction of the elastic force of the spring 170, that is, toward the removal direction A2. When the toner cartridge 100 reaches the mounting position, as shown in FIG. 5, the toner outlet 102 is aligned with the opening 141 to open the toner outlet 102. When the toner cartridge 100 is pulled toward the removal direction A2 in the state shown in FIG. 5, the shutter 140 is moved toward the mounting direction A1 relative to the housing 101 by the elastic force of the spring 170. As shown in FIG. 4, when the contact between the latching portion 142 and the opening lever 503 ends, the toner outlet 102 and the opening 141 are misaligned and the toner outlet 102 is closed.

An example of a structure in which the protruding member 160 is converted to the retracted position and the protruding position in conjunction with movement of the shutter 140 will be described below.

Referring to FIGS. 6 and 7, the driven coupler 150 may include a power transmitter 151 for rotating the conveying member. The power transmitter 151 may be, for example, a gear, and may be connected to the toner discharge member 110 and the paddle members 120 and 130 by a gear connection structure.

The protruding member 160 has the rotational force receiver 162. The protruding member 160 is supported by the extension 152 so as to be rotated between the retracted position and the protruding position. For example, a through portion 153 may be provided in the extension 152. The through portion 153 may penetrate the extension 152 in a radial direction. The protruding member 160 may be installed in the through portion 153 to be rotated between the retracted position and the protruding position. A support shaft 154 that crosses the through portion 153 may be provided, and the protruding member 160 may be supported to be rotated relative to the support shaft 154. In this example, a pair of protruding members 160 may be supported to be rotated by the support shaft 154.

The protruding member 160 may include an interference portion 161. With the support shaft 154 therebetween, the rotational force receiver 162 may be on the mounting direction A1 side, and the interference portion 161 may be on the removal direction A2 side. With the protruding member 160 located in the retracted position, the interference portion 161 may protrude outward of the extension 152 further than the rotational force receiver 162.

The extension 152 extends in an axial direction from the power transmitter 151. A portion of extension 152 may extend beyond a sidewall 103 (of FIG. 4) of the housing 101. The rotational force receiver 162 may be outside the sidewall 103 of the housing 101.

The toner cartridge 100 may include a coupler cover 180. The coupler cover 180 is connected to the shutter 140 and moved together with the shutter 140. In an example, the coupler cover 180 may be integrally formed with the shutter 140. Accordingly, the coupler cover 180 may be moved between the closed position and the open position together with the shutter 140.

The coupler cover 180 may interfere with the interference portion 161 as the shutter 140 moves between the closed position and the open position to convert the protruding member 160 from the retracted position to the protruding position. The coupler cover 180 may interfere with the rotational force receiver 162 as the shutter 140 moves between the open position and the closed position to convert the protruding member 160 from the protruding position to the retracted position. For example, the coupler cover 180 may be in the form of a ring surrounding the extension 152.

In a state in which the toner cartridge 100 is removed from the main body 500, the shutter 140 is located in the closed position by the elastic force of the spring 170. As shown in FIG. 6, the protruding member 160 is located in the retracted position in which the rotational force receiver 162 is received into the extension 152. The coupler cover 180 is located on the mounting direction A1 side of the support shaft 154. The coupler cover 180 is located in a protective position surrounding the rotational force receiver 162 of the protruding member 160 in the retracted position. Thus, while the toner cartridge 100 is handled, the rotational force receiver 162 may be protected from an impact by an external force.

When the toner cartridge 100 is mounted on the main body 500, as the shutter 140 is moved between the closed position and the open position, the coupler cover 180 is moved to a conversion position that allows conversion from the protective position to the protruding position of the protruding member 160.

The toner cartridge 100 is inserted into the mounting portion 502 and pushed in the mounting direction A1. The coupler cover 180 is held in a protective position until the toner cartridge 100 approaches the mounting position. When the toner cartridge 100 approaches the mounting position, the latching portion 142 of the shutter 140 is caught by the opening lever 503. When the toner cartridge 100 continues to be pushed in the mounting direction A1, the shutter 140 and the coupler cover 180 are moved toward the removal direction A2 relative to the housing 101. The coupler cover 180 is moved from the protective position toward the removal direction A2 and starts to interfere with the interference portion 161. In that case, the protruding member 160 starts to rotate about the support shaft 154 from the retracted position to the protruding position. When the toner cartridge 100 reaches the mounting position, the shutter 140 reaches the open position as shown in FIG. 5, and the coupler cover 180 reaches the conversion position as shown in FIG. 7. In the conversion position, the coupler cover 180 interferes with the interference portion 161 to keep the protruding member 160 in the protruding position. The rotational force receiver 162 protrudes from the extension 152. Although not shown in the drawings, the rotational force receiver 162 protruding from the extension 152 is inserted into the rotational force transmitter 552 of the driving coupler 550. Therefore, when the driving coupler 550 is rotated, the driven coupler 150 may also rotate.

When the toner cartridge 100 is pulled toward the removal direction A2 in the state shown in FIGS. 5 and 7, the shutter 140 and the coupler cover 180 are moved toward the mounting direction A1 relative to the housing 101 by the elastic force of the spring 170. When the contact between the latching portion 142 and the opening lever 503 ends, the shutter 140 moves between the open position and the closed position as shown in FIG. 4, and the coupler cover 180 moves between the conversion position and the protective position as shown in FIG. 6. In the process of moving between the conversion position and the return position, the coupler cover 180 interferes with the rotational force receiver 162 protruding from the extension 152. In that case, the protruding member 160 is rotated about the support shaft 154 to move between the protruding position and the retracted position. The coupler cover 180 in the protective position surrounds the rotational force receiver 162. Therefore, the rotational force receiver 162 may be protected from an external impact.

Figure 8:
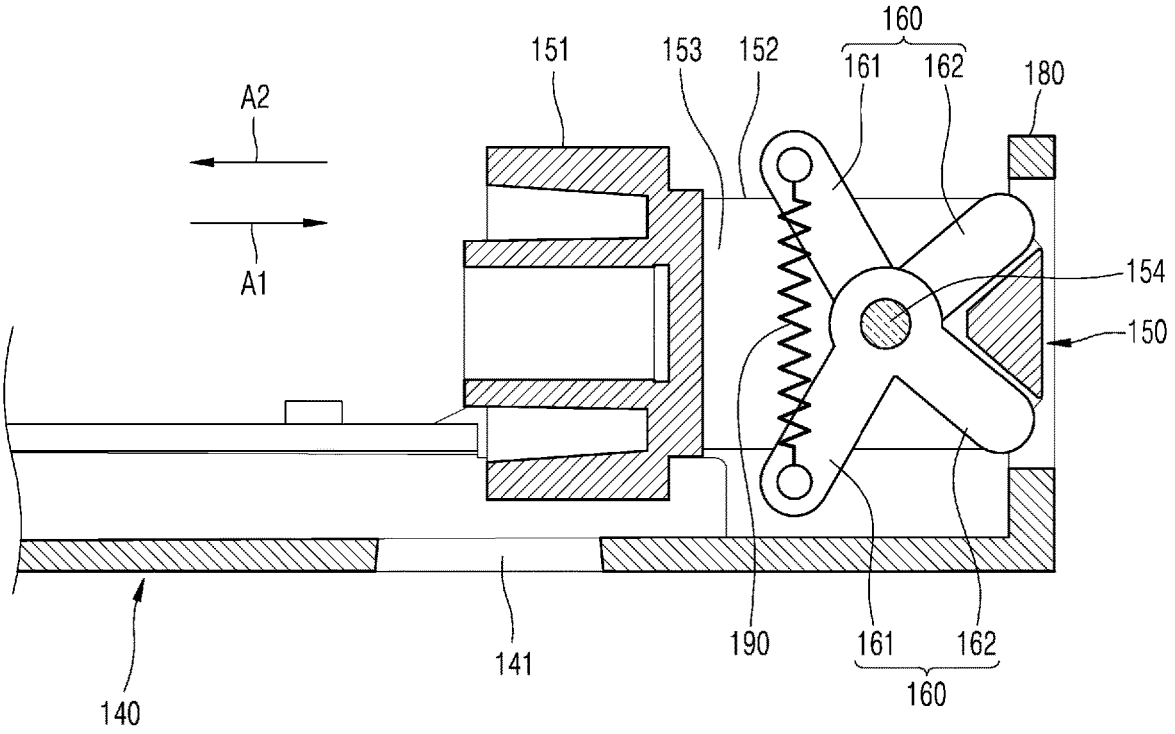
FIG. 8 is a cross-sectional view of a structure capable of reducing or preventing damage caused by an external impact to a rotational force receiver and illustrates a state in which a coupler cover is located in a protective position according to an example.
Figure 9:
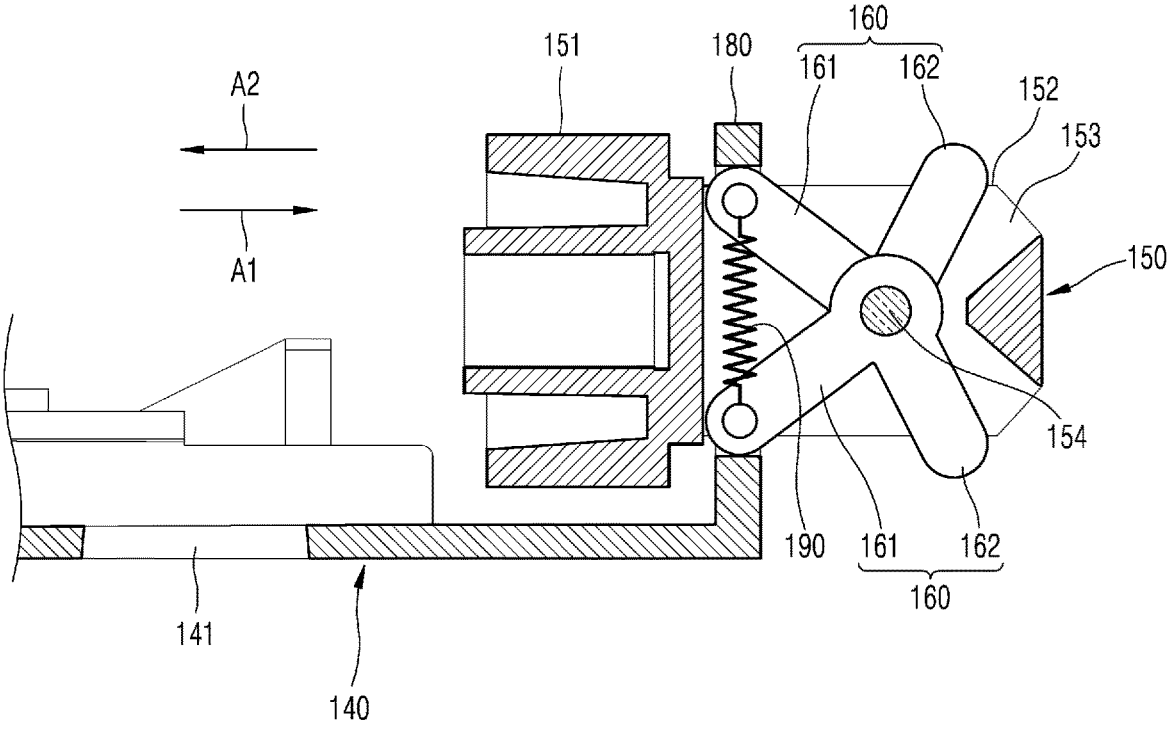
FIG. 9 is a cross-sectional view of a structure capable of reducing or preventing damage caused by an external impact to a rotational force receiver and illustrates a state in which a coupler cover is located in a conversion position according to an example.

FIGS. 8 and 9 are cross-sectional views illustrating an example of a structure capable of reducing or preventing damage to the rotational force receiver 162 from external impact, wherein FIG. 8 shows a state in which the coupler cover 180 is located in a protective position and FIG. 9 shows a state in which the coupler cover 180 is located in a conversion position. The example illustrated in FIGS. 8 and 9 differs from the example shown in FIGS. 4 to 7 in that the example of FIGS. 8 and 9 has an elastic member 190 that applies an elastic force to the protruding member 160 in a direction to be located in a protruding position. Hereinafter, the differences will be mainly described.

Referring to FIGS. 8 and 9, the pair of protruding members 160 are supported to be rotated to the support shaft 154. The rotational force receiver 162 and the interference portion 161 may be located at both sides of the support shaft 154. Based on the support shaft 154, the rotational force receiver 162 may be on the mounting direction A1 side, and the interference portion 161 may be on the removal direction A2 side. In an example, the elastic member 190 may be implemented by a tension coil spring connected to two interference portions 161 of the pair of protruding members 160.

Referring to FIG. 8, the shutter 140 is located in a closed position and the coupler cover 180 is located in the protective position. An elastic force is applied to the protruding member 160 by the elastic member 190 in a direction towards the protruding position. However, since the rotational force receiver 162 is in contact with the coupler cover 180 located in the protective position, the protruding member 160 is maintained in a retracted position.

When the toner cartridge 100 is inserted into the mounting portion 502 of the main body 500 to approach the mounting position, the shutter 140 and the coupler cover 180 are moved to an open position and a conversion position, respectively. When the contact between the coupler cover 180 and the rotational force receiver 162 ends and the coupler cover 180 is apart from the rotational force receiver 162, the protruding member 160 is rotated to the protruding position as shown in FIG. 9 by an elastic force of the elastic member 190. In that case, the rotational force receiver 162 protrudes from the extension 152.

In a state shown in FIG. 9, when the coupler cover 180 is moved toward the protective position, the rotational force receiver 162 interferes with the coupler cover 180, and the protruding member 160 is rotated from the protruding position to the retracted position. When the coupler cover 180 reaches the protected position, as shown in FIG. 8, the protruding member 160 returns to the retracted position.

The elastic member 190 may be implemented in various forms. For example, the elastic member 190 may be implemented by a torsion coil spring in which a winding portion is inserted into the support shaft 154 and the first arm and the second arm are respectively supported by two rotational force receivers 162 of the pair of the protrusion members 160 and apply an elastic force to the protrusion members 160 in a direction to rotate to the protruding position. In this case, the interference portion 161 may be omitted.

In the above-described example, a structure in which the shutter 140 and the coupler cover 180 are formed integrally has been described. However, the shutter 140 and the coupler cover 180 may be separate members.

Figure 10:
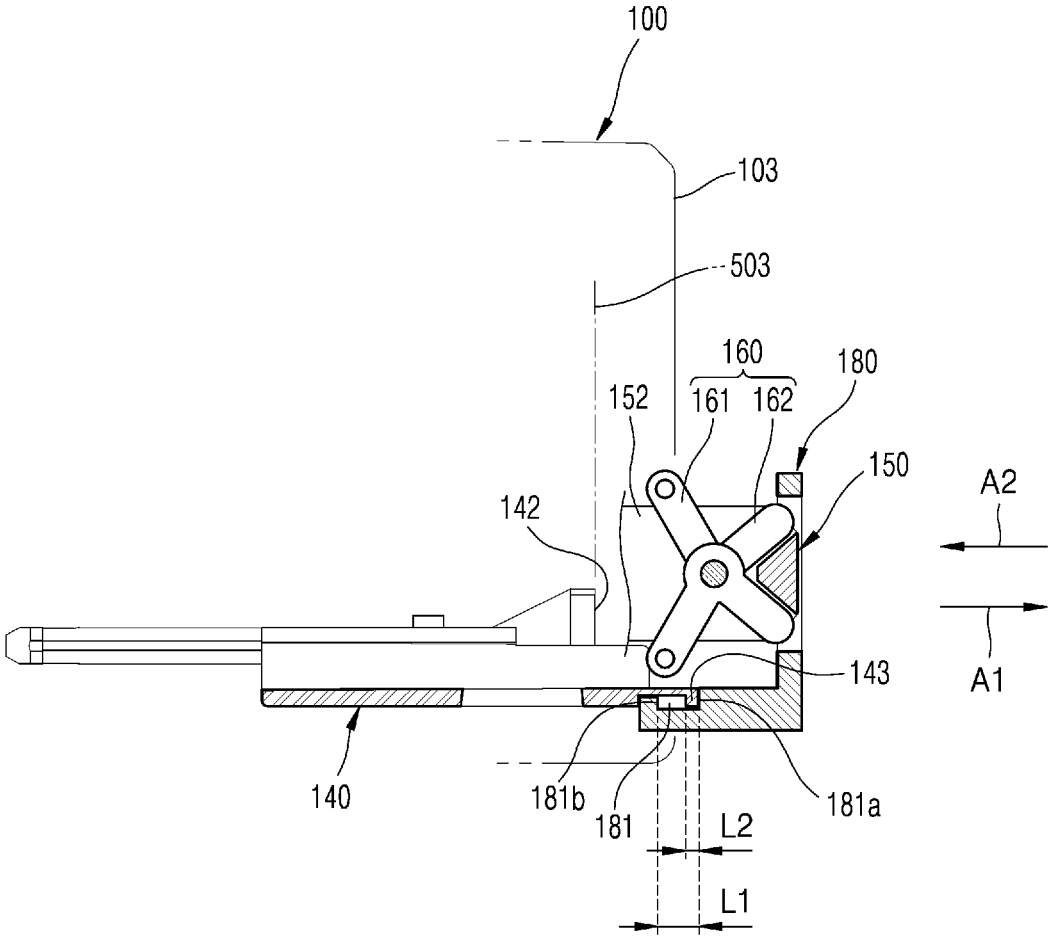
FIG. 10 is a side view of a connection structure of a shutter and a coupler cover and illustrates a state in which the coupler cover is located in a protective position according to an example.
Figure 11:
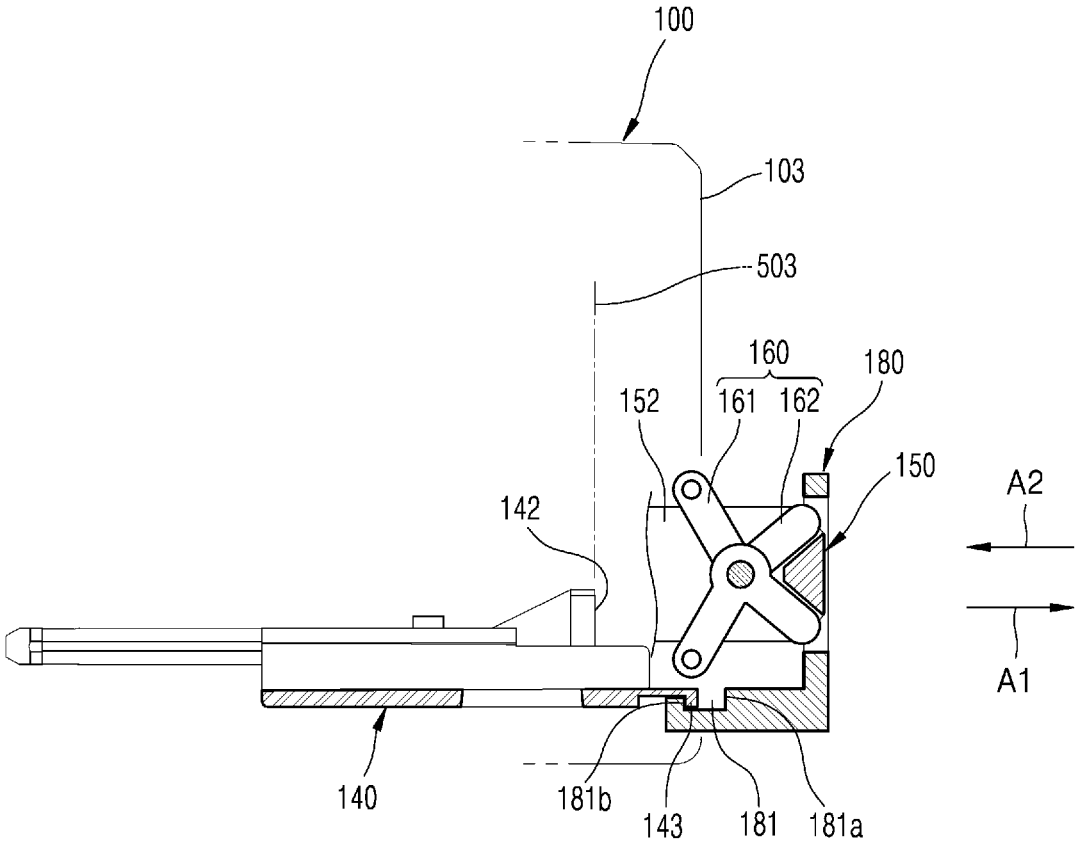
FIG. 11 is a side view of a connection structure of a shutter and a coupler cover and illustrates a state in which the coupler cover and the shutter are connected to each other according to an example.
Figure 12:
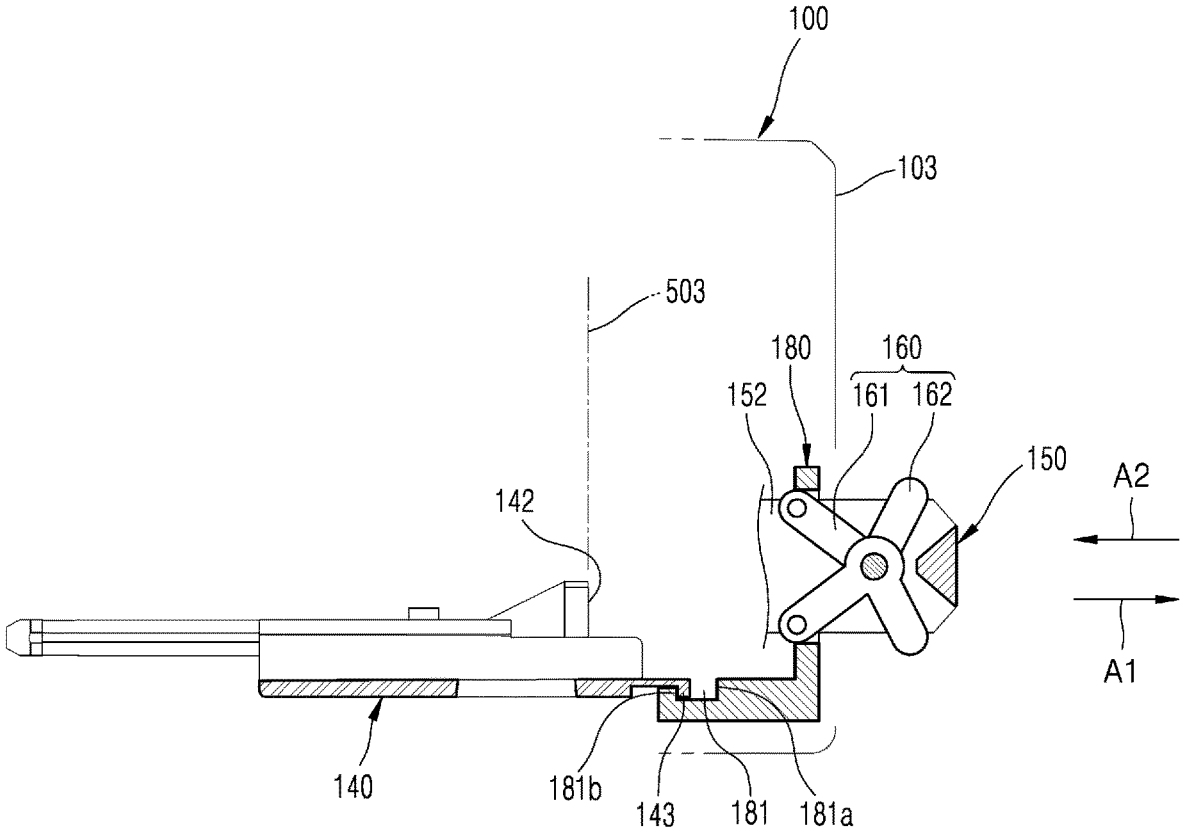
FIG. 12 is a side view of a connection structure of a shutter and a coupler cover and illustrates a state in which the coupler cover is located in a conversion position according to an example.

FIGS. 10 to 12 are side views illustrating an example of a connection structure of the shutter 140 and the coupler cover 180, wherein FIG. 10 shows a state in which the coupler cover 180 is located in a protective position, FIG. 11 shows a state in which the coupler cover 180 and the shutter 140 are connected, and FIG. 12 shows a state in which the coupler cover 180 is located in a conversion position. An example of a connection structure of the shutter 140 and the coupler cover 180 shown in FIGS. 10 to 12 may be applied to examples of the structure capable of reducing or preventing damage to the rotational force receiver 162 from external impact shown in FIGS. 4 to 8.

Referring to FIGS. 10 to 12, the coupler cover 180 includes a first connector 181. The shutter 140 includes a second connector 143. The second connector 143 is connected to the first connector 181 such that the coupler cover 180 may be moved together with the shutter 140. In an example, one of the first connector 181 and the second connector 143 may be a protrusion, and the other may be a groove into which the protrusion is inserted. A length of the groove may be longer than a length of the protrusion based on a moving direction of the shutter 140. According to such a configuration, the amount of movement of the shutter 140 and the coupler cover 180 is changed by the difference between the length of the groove and the length of the protrusion.

A first stroke between open and closed positions of the shutter 140 and a second stroke between the protective position and the conversion position of the coupler cover 180 may be different from each other. For example, the first stroke may be greater than the second stroke. In this case, the difference between the length of the groove and the length of the protrusion may be equal to the difference between the first stroke and the second stroke.

In an example, the first connector 181 is in the form of a groove, and the second connector 143 is in the form of a protrusion inserted into the first connector 181. A length L1 of the first connector 181 is longer than a length L2 of the second connector 143.

With the toner cartridge 100 separated from the main body 500, the shutter 140 is located in the closed position and the coupler cover 180 is located in the protective position. In this state, the second connector 143 is in contact with an end portion 181*a* toward the mounting direction A1 of the first connecting portion 181 as shown in FIG. 10. In this state, the toner cartridge 100 is inserted into the mounting portion 502 of the main body 500 and pushed in the mounting direction A1. When the toner cartridge 100 approaches a mounting position, the latching portion 142 of the shutter 140 contacts the opening lever 503 provided in the mounting portion 502 as shown in FIG. 10. Until this time, the shutter 140 is maintained in the closed position, the coupler cover 180 is maintained in the protective position, and the protruding member 160 is maintained in the retracted position.

In the state shown in FIG. 10, even if the toner cartridge 100 is further pushed in the mounting direction A1, the shutter 140 does not move in the mounting direction A1, and the coupler cover 180 and the driven coupler 150 are moved together with the toner cartridge 100 in the mounting direction A1. The shutter 140 is moved relative to the toner cartridge 100 in the removal direction A2. Accordingly, the coupler cover 180 is maintained in the protective position, and the second connector 143 is moved from the end portion 181*a* of the mounting direction A1 of the first connector 181 toward an end portion 181*b* of the removal direction A2.

As shown in FIG. 11, the second connector 143 of the shutter 140 contacts the end portion 181*b* of the removal direction A2 of the first connector 181. In this state, when the toner cartridge 100 is further pushed in the mounting direction A1, the shutter 140 continues to move relative to the toner cartridge 100 in the removal direction A2. Since the second connector 143 of the shutter 140 pulls the first connector 181 of the coupler cover 180 toward the removal direction A2, the coupler cover 180 is relatively moved with the shutter 140 in the removal direction A2. The driven coupler 150 is moved in the mounting direction A1 together with the toner cartridge 100. Thus, the coupler cover 180 is moved away from the protective position toward the conversion position.

When the toner cartridge 100 reaches the mounting position, the shutter 140 reaches the open position and the coupler cover 180 reaches the conversion position as shown in FIG. 12. The protruding member 160 is rotated to a protruding position by interference between the coupler cover 180 and the interference portion 161 or by the elastic force of the elastic member 190.

In the state shown in FIG. 12, when the toner cartridge 100 is pulled toward the removal direction A2, the coupler cover 180 may be maintained in the conversion position until the second connector 143 contacts the end portion 181*a* of the mounting direction A1 of the first connector 181. Subsequently, when the toner cartridge 100 is moved toward the removal direction A2, the driven coupler 150 is moved in the removal direction A2, but the coupler cover 180 is not moved in the removal direction A2. Therefore, the coupler cover 180 is moved toward the mounting direction A1 relative to the driven coupler 150, and is converted from the conversion position to the protective position. The protruding member 160 is converted from the protruding position to the retracted position by interference between the coupler cover 180 and the rotational force receiver 162.

Subsequently, when the toner cartridge 100 is moved in the removal direction A2 to terminate interference between the latching portion 142 of the shutter 140 and the opening lever 503, as shown in FIG. 10, the shutter 140 reaches the closed position and the coupler cover 180 is maintained in the protective position.

By examples of the above-described structure, even when the first stroke between the open position and the closed position of the shutter 140 and the second stroke between the protective position and the conversion position of the coupler cover 180 are different from each other, a structure to protect the rotational force receiver 162 from external impact may be implemented. In addition, since the first stroke of the shutter 140 may be lengthened, a stable amount of toner may be supplied to the developing unit 200 by increasing the amount of opening of the toner outlet 102. In addition, even when the first stroke of the shutter 140 is long, the amount of protrusion from the side of the housing 101 of the driven coupler 150 may be reduced, thereby stably protecting the driven coupler 150 from external impact.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A toner cartridge comprising:

a housing to contain toner therein and having a toner outlet;

a conveying member;

a shutter to open and close the toner outlet;

a driven coupler to rotate the conveying member and having an extension that extends in an axial direction;

a protruding member including a rotational force receiver and installed in the extension to move between a protruding position in which the rotational force receiver protrudes from the extension and a retracted position in which the rotational force receiver is received into the extension in conjunction with an opening operation and a closing operation of the shutter;

an interference portion provided in the protruding member; and a coupler cover, connected to the shutter, to interfere with the interference portion as the shutter moves from a closed position toward an open position to move the protruding member from the retracted position toward the protruding position, and to interfere with the rotational force receiver as the shutter is moved from the open position toward the closed position to move the protruding member from the protruding position toward the retracted position.

2. The toner cartridge of claim 1, wherein the coupler cover is to cover the rotational force receiver when the shutter is in the closed position.

3. The toner cartridge of claim 1, further comprising an elastic member to apply an elastic force to the protruding member in a direction to be located in the protruding position.

4. The toner cartridge of claim 3, wherein the coupler cover is to contact the rotational force receiver to maintain the protruding member in the protruding position when the shutter is in the closed position.

5. The toner cartridge of claim 1, wherein the coupler cover is integral with the shutter.

6. The toner cartridge of claim 1, further comprising:

a first connector provided on the coupler cover; and a second connector provided in the shutter and connected to the first connector to move the coupler cover together with the shutter, wherein one of the first connector and the second connector includes a protrusion, the other of the first connector and the second connector includes a groove into which the protrusion is inserted, and a length of the groove is longer than a length of the protrusion based on a moving direction of the shutter.

7. The toner cartridge of claim 1, further comprising:

an elastic member to apply an elastic force to the protruding member in a direction of moving the protruding member toward the protruding position; and the coupler cover, connected to the shutter, to be in contact with the rotational force receiver when the shutter is in the closed position to maintain the protruding member in the retracted position, and to be apart from the rotational force receiver such that the rotational force receiver is moved to the protruding position by an elastic force of the elastic member as the shutter is moved from the closed position toward the open position.

8. A toner cartridge comprising:

a housing to contain toner therein and having a toner outlet;

a conveying member;

a shutter movable between a closed position for closing the toner outlet and an open position for opening the toner outlet;

a driven coupler to rotate the conveying member and having an extension that extends in an axial direction;

a protruding member provided with a rotational force receiver and installed in the extension to be moved between a protruding position in which the rotational force receiver protrudes from the extension and a retracted position in which the rotational force receiver is received into the extension; and a coupler cover, connected to the shutter, to move between a protective position to cover the rotational force receiver of the protruding member located at the retracted position and a conversion position to allow movement of the protruding member to the protruding position as the shutter moves between the closed position and the open position.

9. The toner cartridge of claim 8, further comprising an elastic member to apply an elastic force to the protruding member in a direction to be located in the protruding position.

10. The toner cartridge of claim 8, further comprising an interference portion provided in the protruding member, wherein, in the conversion position, the coupler cover is to interfere with the interference portion to move the protruding member from the retracted position toward the protruding position.

11. The toner cartridge of claim 10, wherein the coupler cover is to interfere with the rotational force receiver as the shutter is moved from the open position toward the closed position to move the protruding member from the protruding position toward the retracted position.

12. The toner cartridge of claim 8, further comprising:

a first connector provided on the coupler cover; and a second connector provided in the shutter and connected to the first connector to move the coupler cover together with the shutter, wherein one of the first connector and the second connector includes a protrusion, the other of the first connector and the second connector includes a groove into which the protrusion is inserted, and a length of the groove is longer than a length of the protrusion based on a moving direction of the shutter.

13. The toner cartridge of claim 8, wherein the coupler cover is integral with the shutter.

* * * * *